US006105392A

United States Patent [19]

Biagi

[11] Patent Number: 6,105,392

[45] Date of Patent: Aug. 22, 2000

[54] EARRING PIERCING AND FASTENING SYSTEMS AND METHODS

[76] Inventor: Kathalean M. Biagi, 1834 Shadyhill Ter., Winter Park, Fla. 32792

[21] Appl. No.: 09/226,479

[22] Filed: Jan. 7, 1999

Related U.S. Application Data

[63] Continuation-in-part of application No. PCT/US97/12901, Jul. 23, 1997, which is a continuation-in-part of application No. 08/815,838, Mar. 12, 1997, Pat. No. 5,893,277.

[51] Int. Cl.[7] ..... A44C 7/00

[52] U.S. Cl. ..... 63/12

[58] Field of Search ..... 63/12, 13; 24/707.6, 24/707.5, 707.2, 705, 706.9

[56] References Cited

U.S. PATENT DOCUMENTS

| | | | |
|---|---|---|---|
| D. 249,252 | 9/1978 | Gatof . | |
| 2,568,207 | 9/1951 | Spicher | 606/188 |
| 3,789,850 | 2/1974 | Ford . | |
| 4,139,993 | 2/1979 | Tucker . | |
| 4,195,492 | 4/1980 | Johnson . | |
| 4,242,886 | 1/1981 | Tucker . | |
| 4,501,050 | 2/1985 | Fountoulakis . | |
| 4,580,417 | 4/1986 | Sardelli . | |
| 4,630,453 | 12/1986 | Burkett . | |
| 4,771,613 | 9/1988 | Grier et al. . | |
| 4,829,788 | 5/1989 | DiDomenico . | |
| 4,901,409 | 2/1990 | Seidman . | |
| 4,928,367 | 5/1990 | Seidman . | |
| 5,018,365 | 5/1991 | Luceno . | |
| 5,154,068 | 10/1992 | DiDomenico . | |
| 5,375,433 | 12/1994 | Skalet . | |
| 5,454,829 | 10/1995 | Koland . | |
| 5,456,094 | 10/1995 | Greenwald . | |
| 5,669,239 | 9/1997 | Tobita . | |

FOREIGN PATENT DOCUMENTS

| | | |
|---|---|---|
| 2239781 | 7/1991 | United Kingdom . |
| 2239252 | 5/1992 | United Kingdom . |

*Primary Examiner*—Kien T. Nguyen
*Attorney, Agent, or Firm*—Allen, Dyer, Doppelt, Milbrath & Gilchrist, P.A.

[57] ABSTRACT

A body piercing assembly is provided that is comfortable to wear even when sleeping and is easily manipulable when it is desired to change the decorative portion of the earring. A post has an attachment element for affixing an ornament thereto. A piercing element is provided that is adapted for being driven from a first side of a body part through to a second side of the body part, such as by a powered "piercing gun." A tubular back portion admits at least a front section of the post and is reversibly affixable thereto. A back element includes a generally flat disc adapted to ensure maximum comfort to the wearer and a generally cylindrical tube for receiving and reversibly mating with at least a rear section of the post. An additional embodiment includes a device for affixing two ornamental objects into a body pierce simultaneously. A post element is dimensioned for insertion through a pierced body part. The post element is attachable to a decorative object at both a first end and a second end.

8 Claims, 4 Drawing Sheets

EARRING PIERCING AND FASTENING SYSTEMS AND METHODS

CROSS-REFERENCE TO RELATED APPLICATIONS

The present application is a continuation-in-part to PCT application PCT/US97/12901, filed Jul. 23, 1997, designating the United States, which is a continuation-in-part of U.S. patent application Ser. No. 08/815,838, filed Mar. 12, 1997 now U.S. Pat. No. 5,893,277.

BACKGROUND OF THE INVENTION

1. Field of the Invention

The present invention relates to ornamental jewelry, and, more particularly, to jewelry for pierced body parts, such as earrings, and to devices and methods for piercing body parts.

2. Description of Related Art

Several types of fastening devices are known for attaching ornamental jewelry to pierced body parts, such as earrings for attachment to earlobes. Among these are conventional posts that typically are inserted from the front to the back of the earlobe and then are held in place by any of a variety of back pieces. In these types of fastener the back piece generally has a hole therethrough that is dimensioned to provide a friction fit between the back piece and the post. In addition, the post usually has a notch adjacent its back end that serves two purposes: (1) to provide the user with a perceptible indication that the post and back piece are sufficiently mated to keep the earring in place; and (2) to provide a slight barrier to the removal of the back piece once it has been pushed toward the front of the post past the notch.

Variations on the conventional earring attachment devices have been disclosed by Ford (U.S. Pat. No. 3,789,850), Johnson (U.S. Pat. No. 4,195,492), Tucker (U.S. Pat. Nos. 4,242,886 and 5,546,094), Fountoulakis (U.S. Pat. No. 4,501,050), Sardelli (U.S. Pat. No. 4,580,417), Burkett (U.S. Pat. No. 4,630,453), DiDomenico (U.S. Pat. Nos. 4,829,788 and 5,154,068), Seidman (U.S. Pat. Nos. 4,901,409 and 4,928,367), Grier et al. (U.S. Pat. No. 4,771,613), Luceno (U.S. Pat. No. 5,018,365), Skalet (U.S. Pat. No. 5,375,433), Koland (U.S. Pat. No. 5,454,829), Greenwald (U.S. Pat. No. 5,456,094), Tobita (U.S. Pat. No. 5,669,239), Froud (GB 2,239,781), and Cale et al. (GB 2,249,252).

A platform for clipon-type or screwon-type earrings has also been disclosed by Tucker (U.S. Pat. No. 4,139,993). This device is adapted to receive the securing means of conventional nonpierced earrings but not itself to serve as decorative jewelry.

Several problems still exist in the known devices for affixing ornamental jewelry such as earrings to a pierced body part. For example, none of the known devices is comfortable for wearing while sleeping. In addition, a certain amount of digital acuity is required for inserting the post and affixing the back thereto. Such acuity is lacking in some individuals, either owing to aging or to a physical infirmity.

Further, when the earlobe or other body part is first pierced, the wearer typically is required to wear a standard ornament during the healing process, which may take several weeks. The wearer thus cannot immediately begin wearing desired fashion accessories.

SUMMARY OF THE INVENTION

It is therefore an object of the present invention to provide an improved back for affixing ornamental jewelry to a pierced body part.

It is a further object to provide such a back that affords increased comfort to the wearer.

It is another object to provide such a back that can remain in place while interchanging decorative ornaments on an opposite side of the pierced site.

It is an additional object to provide a guide for implementing the use of the improved back.

It is yet a further object to provide a back that is adaptable to a range of widths of the section of body to be spanned.

It is yet another object to provide a device for wearing a desired accessory immediately following a piercing of the body part.

It is yet an additional object to provide a device for wearing two accessories simultaneously with one hidden from view.

These and other objects are attained with the ornamental jewelry assembly of the present invention. It is to be understood throughout that, although the term earring is utilized in the following description, any decorative ornament for use in a pierced body part is intended to be encompassed thereby.

The ornamental jewelry assembly is intended for insertion into a pierced body part. The assembly comprises an earring post that has attachment means such as a notch adjacent its back end and a length that is sufficient to span the pierced body part. The post additionally has means for affixing a decorative object to its front end thereof.

The assembly further comprises an earring back, which includes an elongated member that has an open front end that is dimensioned to admit the earring post thereinto. The earring back also has a attachment means such as a notch adjacent the front end. The notch is positioned and dimensioned to provide a friction fit between the tube and the post and also to engage the post notch. The notch is also intended to provide an indication to a wearer that the post and the tube have mated sufficiently to retain the post within the tube.

The earring back additionally includes a generally flat disc that is affixed to the tube's back end of the tube in a generally normal orientation thereto. The disc is preferably dimensioned to prevent passage into a pierced hole of an earlobe of the wearer and is also preferably smooth and generally flat on both faces for the wearer's comfort.

In an alternate embodiment, an ornamental jewelry insertion assembly, there is provided, in addition to the earring back, a post guide for assisting in inserting the back tube into the earlobe hole. The post guide comprises means for gripping at a front end, which is dimensioned to prevent passage into the earlobe hole. Affixed to the back end of the gripping means is a shaft, which is sufficiently long to penetrate through the earlobe hole. The shaft has a notch that is positioned adjacent the front end. The notch is positioned and dimensioned to provide a friction fit between the tube and the shaft and to engage the tube notch. The notch also serves to provide an indication to a wearer that the shaft and the tube have mated sufficiently to retain the tube within the earlobe hole.

This insertion assembly is used by inserting the post guide shaft into the earlobe hole from front to back while holding the gripping means. Next the tube is inserted into the earlobe hole from back to front, so that it surrounds the shaft until the tube notch and the shaft notch are in contact. Then the shaft is removed, leaving the tube in the earlobe hole. Now that the tube is in place in the earlobe, it is easier to insert an earring post.

In another embodiment, instead of a friction fit, threaded areas are provided on the earring post and shaft, and a corresponding grooved area is provided within the tube to permit a screw-type fit between the mating elements. It will be apparent to one of skill in the art that alternate attachment means may be contemplated in addition to those indicated here.

An additional embodiment includes a device for affixing two ornamental objects into a body pierce simultaneously. This device comprises a post element that is dimensioned for insertion through a pierced body part. The post element has means for attaching to a decorative object at both a first end and a second end. This device confers at least two benefits: When used in the ear, during traveling, for example, two valuable ornaments, such as jewels, can be worn in each at all times, one of them being hidden behind the ear lobe, so that both are on one's person and not left behind in a suitcase or at a hotel. Second, in a body pierce wherein both ends of the pierce are in view, both can carry decorative and interchangeable elements.

In yet a further embodiment, a body piercing system is disclosed that comprises a piercing element that is adapted for being driven from a first side of a body part through to a second side of the body part, such as by a powered "piercing gun." The piercing element has a pointed front end and a generally cylindrical post extending from the front end. The post has attachment means disposed adjacent the post's back end.

A back element is also provided that comprises a generally flat disc that is dimensioned to prevent a passage into a pierced hole of a body part of a wearer. This flat disc is adapted to ensure maximum comfort to the wearer. For example, if used as an ear-piercing device, this flat back will press against the neck of the wearer during sleep. Other previously known earring assemblies include protrusions that can cause discomfort during resting.

The back element also includes a generally cylindrical tube that is affixed to a front face of the disc. The tube is dimensioned for passage into the pierced hole and has a bore extending from a front end. This bore is dimensioned to receive at least a rear section of the post. The tube further has means for reversibly mating with the post attachment means and with an ornament's attachment means.

Thus in use the elements of this system are used by loading the coupled piercing element and back element into a driver such as a piercing gun and piercing the body part, such as by driving the pointed end of the piercing element from the rear side of the earlobe to the front side. The piercing element is decoupled from the tube, leaving the back element in the earlobe. Finally, any desired ornament can be affixed to the affixing means, permitting the user to wear a selection of desired jewelry during the healing process and also conferring increased comfort owing to the flat back disc.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

Figure 1:
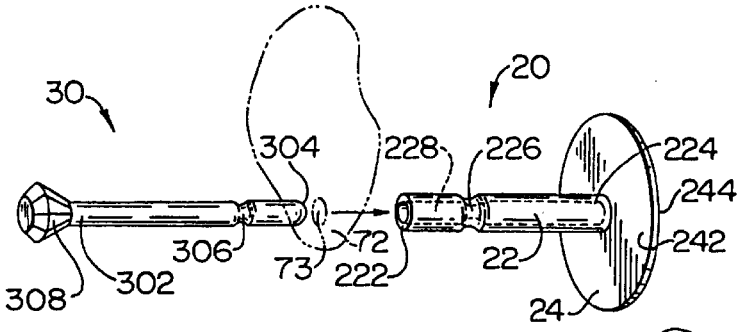
FIG. 1 is a side perspective view of the earring back being mated with an earring post.
Figure 2:
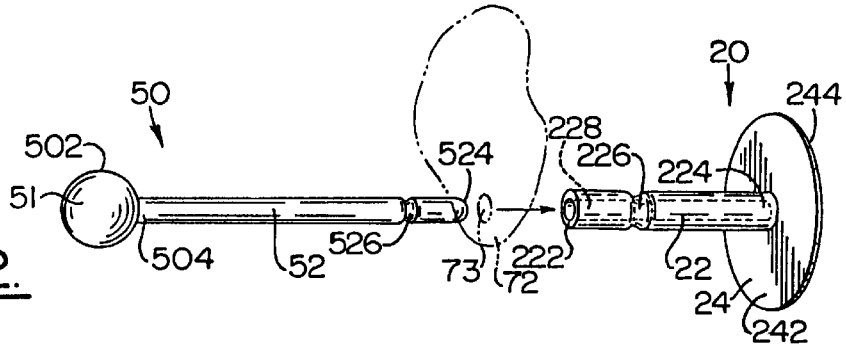
FIG. 2 is a side perspective view of the post guide.

A description of the preferred embodiments of the present invention will now be presented with reference to FIGS. 1–10.

A first embodiment of the invention (FIG. 1) comprises an earring back 20, which is for coupling with an earring post 30 that has a notch 306 adjacent its back end 304. The earring back 20 comprises a generally cylindrical tube 22, which has an open front end 222. The front end 222 is dimensioned to admit the earring post 30 into its bore 228.

The earring back's tube 22 has a notch 226 that is located adjacent the front end 222. The notch 226 is positioned and dimensioned to provide a friction fit between the tube 22 and the post 30 and to engage the post's notch 306. The notches 226,306 also serve to provide an indication to the wearer that the post 30 and the tube 22 have mated sufficiently to retain the post 30 within the tube 22.

The earring back's tube 22 can be made of any suitable material, such as plastic or a hypoallergenic metal.

The earring back 20 also comprises a generally flat disc 24 that is affixed to the back end 224 of the tube 22. The disc 24 is typically affixed so that the tube 22 is in the disc's center and is generally normal thereto. Preferably the disc 24 has smooth front 242 and back 244 sides, in order to maximize the comfort of the wearer. The disc 24 should be dimensioned to prevent passage into the pierced hole 73 of the wearer's earlobe 72.

A second embodiment (FIG. 1), which is an ornamental jewelry assembly, includes, in addition to the back 20 as described above, the post section 30, which has notch 306 adjacent its back end 304. The length of the post 30 should be sufficient to span the pierced body part, in FIG. 1 shown as an earlobe 72, although this is not intended to be a limitation. In a preferred embodiment, the length of the post 30 can be shorter than that of a conventional post, with the disc 24 having no hole therethrough. In this case the post 30 thus does not protrude through the disc 24 as in conventional earring assemblies, which provides increased comfort to the wearer under conditions in which the earlobe 72 may be pressed against the head, such as while sleeping.

The post 30 also has means for affixing a decorative object to its front end 302. As shown, such a decorative object may comprise a gemstone 308.

A third embodiment of the invention (FIG. 2) is intended for use by people who may have difficulty manipulating a post-back assembly. This embodiment includes a post guide 50, which is used for assisting in inserting the back tube into the earlobe hole. The post guide 50 comprises means for gripping at a front end 502 that is dimensioned to prevent passage into the earlobe hole.

In a particular embodiment, the gripping means comprises a ball-shaped member 51, but this is not intended as a limitation.

A shaft 52 is affixed to the back end 504 of the ball-shaped member 51. The shaft 52 has a length that is sufficient to penetrate through the earlobe hole, and in a preferred embodiment is significantly longer than that earlobe hole passage, in order to provide sufficient extra length to aid the wearer in positioning the back tube 22.

A notch 526 is positioned to be adjacent the shaft's front end 524. The shaft's notch 526 is positioned and dimensioned to provide a friction fit between the tube 22 and the shaft 52, and to engage the tube's notch 226. The notch 526 further serves to provide an indication to the wearer that the shaft 52 and the tube 22 have mated sufficiently to retain the tube 22 within the earlobe hole.

In use, then the post guide's shaft 52 is inserted into the earlobe hole from front to back while holding the ball-shaped member 51. Next the tube 22 is inserted into the earlobe hole so that it surrounds the shaft 52 and extends sufficiently far that the tube's 226 and the shaft's 526 notches are in contact. Then the shaft 52 is removed from the earlobe hole, leaving the tube 22 in the earlobe hole. Finally, an earring post 30 may be inserted and affixed to the tube 22 as described above.

Figure 3:
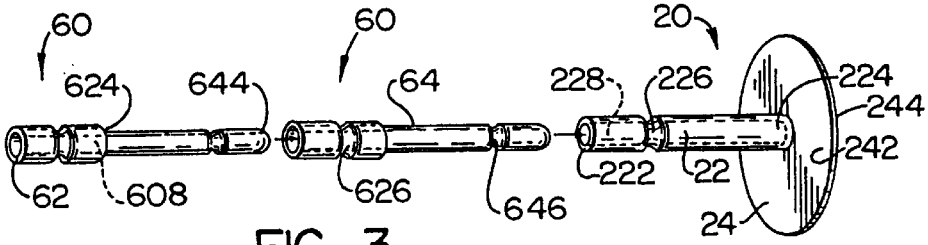
FIG. 3 is a side perspective view of several extension modules being mated with the earring back.

Another embodiment of the invention comprises, in addition to the above-discussed earring back 20, an extension member 60 (FIG. 3). The extension member 60, or a plurality thereof, can be used to adjust for earlobes and/or body parts that are wider than the extent of the post-tube assembly. The extension member 60 has a longitudinal bore 608 therethrough, at least part of which is dimensioned to admit an earring post 30 thereinto.

In a specific embodiment, the extension member 60 comprises a front tubular portion 62 that has a diameter generally commensurate with the diameter of the earring back's tube 22. The front tubular portion 62 also has a notch 626 that is adjacent the back end 624 and is positioned and dimensioned to provide a friction fit between the tubular portion 62 and the earring's post 30. This notch 626 is for engaging the post's notch 306 and for providing an indication to the wearer that the post 30 and the tubular portion 62 have mated sufficiently to retain the post 30 within the tubular portion 62.

The extension member 60 further comprises a generally cylindrical back snap portion 64. The back snap portion 64 has a length and diameter dimensioned for insertion into the earring back tube 22. The back snap portion 64 additionally has a notch 646 that is adjacent the back end 644. The notch 646 is positioned and dimensioned to provide a friction fit between the back snap portion 64 and the earring back tube 22 and to engage the earring back tube notch 226. Thus it can be seen that one or more extension members 60 can be interposed between the earring post 40 and the earring back 20 in order to easily custom fit a comfortable assembly for wearing. This embodiment is not intended to be limiting, and can easily be adapted to other pierced body parts where extension is required.

An alternate to the first embodiment of the invention (FIG. 4) comprises an earring back 40, which is for coupling with an earring post 80 that has a threaded area 806 adjacent its back end 804. The earring back 40 comprises a generally cylindrical tube 42, which has an open front end 422. The front end 422 is dimensioned to admit the earring post 80 into its bore 828.

The earring back's tube 42 has a grooved area 826 that is located adjacent the front end 422. The grooved area 426 is positioned and dimensioned to provide a screw-type fit between the tube 42 and the post 80 and to engage the post's threaded area 806.

The earring back's tube 42 can be made of any suitable material, such as plastic or a hypoallergenic metal.

The earring back 40 also comprises a generally flat disc 44 that is affixed to the back end 424 of the tube 42. The disc 44 is typically affixed so that the tube 42 is in the disc's center and is generally normal thereto. Preferably the disc 44 has smooth front 442 and back 444 sides, in order to maximize the comfort of the wearer. The disc 44 should be dimensioned to prevent passage into the pierced hole 73 of the wearer's earlobe 72.

Figure 4:
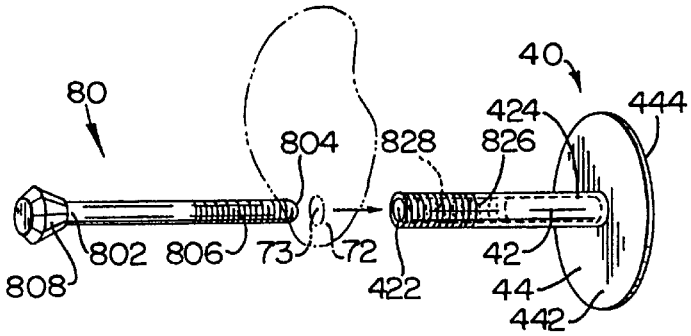
FIG. 4 is a side perspective view of an alternate embodiment of an earring back and earring post being mated.
Figure 5:
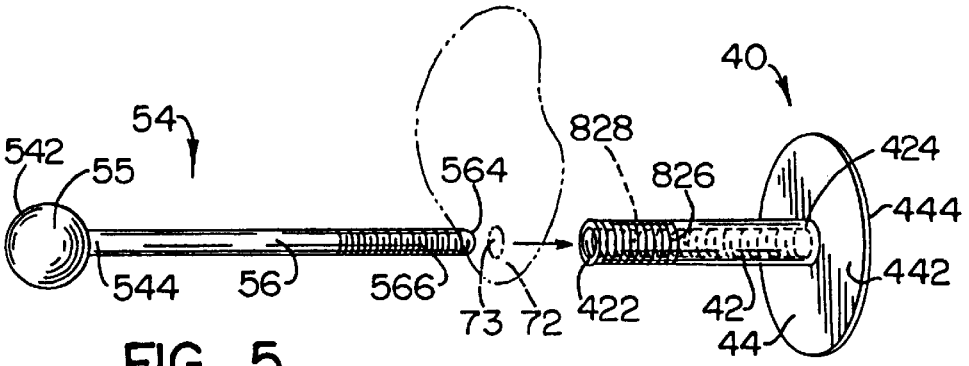
FIG. 5 is a side perspective view of the screw-type post guide.

An alternate to the second embodiment (FIG. 4), which is an ornamental jewelry assembly, includes, in addition to the back 40 as described above, the post section 80, which has threaded area 806 adjacent its back end 804. The length of the post 80 should be sufficient to span the pierced body part, in FIG. 4 shown as an earlobe 72, although this is not intended to be a limitation. In a preferred embodiment, the length of the post 80 can be shorter than that of a conventional post, with the disc 44 having no hole therethrough. In this case the post 80 thus does not protrude through the disc 44 as in conventional earring assemblies, which provides increased comfort to the wearer under conditions in which the earlobe 72 may be pressed against the head, such as while sleeping.

The post 80 also has means for affixing a decorative object to its front end 802. As shown, such a decorative object may comprise a gemstone 808.

An alternate to the third embodiment of the invention (FIG. 5) is intended for use by people who may have difficulty manipulating a post-back assembly. This embodiment includes a post guide 54, which is used for assisting in inserting the back tube into the earlobe hole. The post guide 54 comprises means for gripping at a front end 542 that is dimensioned to prevent passage into the earlobe hole. In a particular embodiment, the gripping means comprises a ball-shaped member 55, but this is not intended as a limitation.

A shaft 56 is affixed to the back end 544 of the ball-shaped member 55. The shaft 56 has a length that is sufficient to penetrate through the earlobe hole, and in a preferred embodiment is significantly longer than that earlobe hole passage, in order to provide sufficient extra length to aid the wearer in positioning the back tube 42.

A threaded area 566 is positioned to be adjacent the shaft's front end 564. The shaft's threaded area 566 is positioned and dimensioned to provide a screw-type fit between the tube 42 and the shaft 56 by engaging the tube's grooved area 826.

In use, then the post guide's shaft 56 is inserted into the earlobe hole from front to back while holding the ball-shaped member 55. Next the tube 42 is screwed into the earlobe hole 73 so that it surrounds the shaft 56. Then the shaft 56 is removed from the earlobe hole, leaving the tube 42 in the earlobe hole. Finally, an earring post 80 may be inserted and affixed to the tube 42 as described above.

Figure 6:
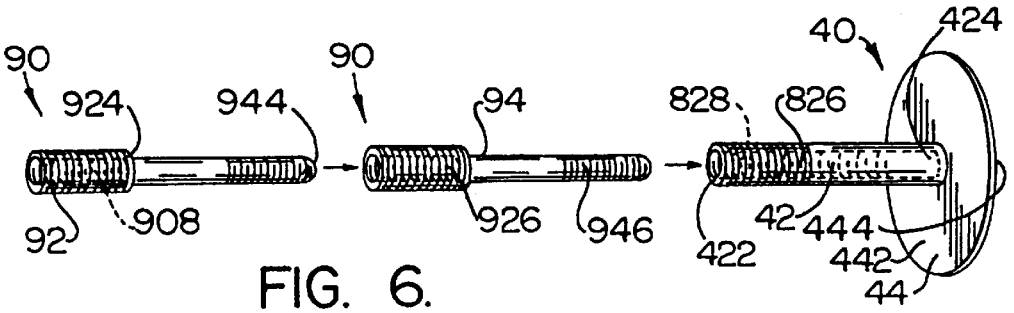
FIG. 6 is a side perspective view of several extension modules being mated with the earring back.
Figure 7:
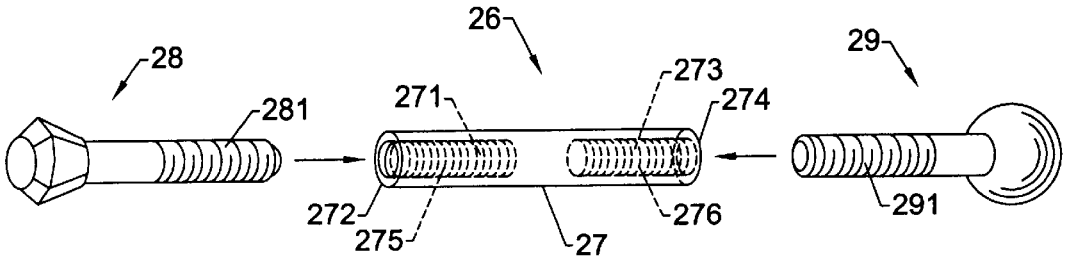
FIG. 7 is a side perspective view of an earring assembly for carrying a pair of ornaments simultaneously.

Another embodiment of the invention comprises, in addition to the above-discussed earring back 40, an extension member 90 (FIG. 6). The extension member 90, or a plurality thereof, can be used to adjust for earlobes and/or body parts that are wider than the extent of the post-tube assembly. The extension member 90 has a longitudinal bore 908 therethrough, at least part of which is dimensioned to admit an earring post 80 thereinto.

In a specific embodiment, the extension member 90 comprises a front tubular portion 92 that has a diameter generally commensurate with the diameter of the earring back's tube 42. The front tubular portion 92 also has a grooved area 926 that is adjacent the back end 924 and is positioned and dimensioned to provide a screw-type fit between the tubular portion 92 and the earring's post 80.

The extension member 90 further comprises a generally cylindrical back portion 94. The back portion 94 has a length and diameter dimensioned for insertion into the earring back tube 42. The back portion 94 additionally has a threaded area 946 that is adjacent the back end 944. The threaded area 946 is positioned and dimensioned to provide a screw-type fit between the back portion 94 and the earring back tube 42 and to engage the earring back tube grooved area 826. Thus it can be seen that one or more extension members 90 can be interposed between the earring post 80 and the earring back 40 in order to easily custom fit a comfortable assembly for wearing. This embodiment is not intended to be limiting, and can easily be adapted to other pierced body parts where extension is required.

It has also been found that the design of the earring fastening system of the present invention can serve to prevent or permit the healing of infections, since there is no protrusion behind the ear that can catch on the wearer's hair or clothing, which can irritate the pierced hole.

In a further embodiment of the present invention, an ornamental jewelry assembly includes a post element that is dimensioned for insertion through a pierced body part. A first subembodiment 26, illustrated in FIG. 7, comprises a generally cylindrical post 27 having a first bore 271 extending from a first end 272 and a second bore 273 extending from a second end 274. The first 271 and the second 273 bore may in fact comprise a unitary bore extending through from the first end 272 to the second end 274. Each bore 271,273 has a threaded portion 275,276 adapted to receive commensurately threaded portions 281,291 of ornaments 28,29 screwingly inserted thereinto, respectively.

Figure 8:
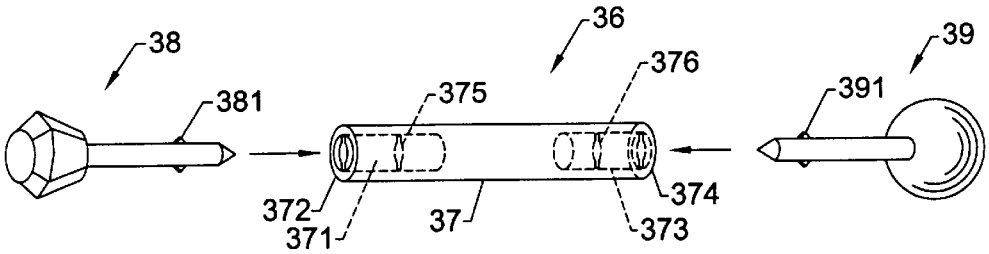
FIG. 8 is a side perspective view of an alternate embodiment of the assembly of FIG. 7.
Figure 9:
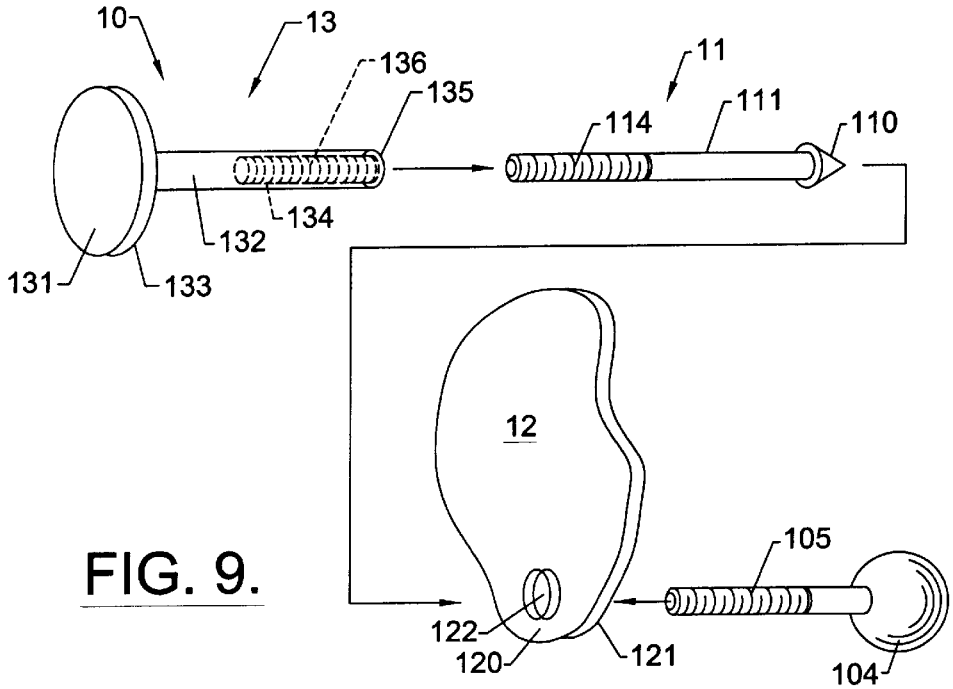
FIG. 9 is a side perspective view of an assembly for use during and after piercing of a body part.
Figure 10:
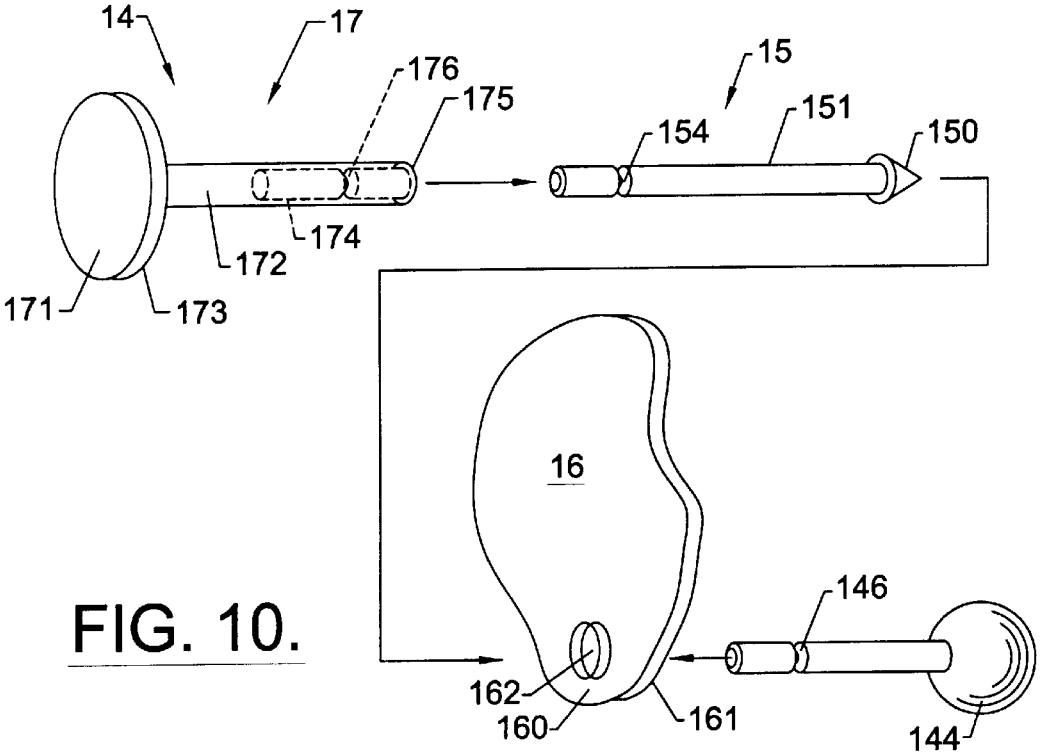
FIG. 10 is an alternate embodiment of a piercing assembly.

A second subembodiment 36, illustrated in FIG. 8, also comprises a generally cylindrical post 37 having a first bore 371 extending from a first end 372 and a second bore 373 extending from a second end 374. The first 371 and the second 373 bore may in fact comprise a unitary bore extending through from the first end 372 to the second end 374. Each bore 371,373 has a pair of notches 375,376 adapted to receive commensurately notched portions 381, 391 of ornaments 38,39 inserted thereinto in a snap fit, respectively.

In yet another embodiment of the present invention, a system and method for piercing a body part are provided wherein an ornamental object 104,144 may be worn immediately after piercing. A first embodiment of this system 10 (FIG. 9) comprises a piercing element 11 adapted for being driven from a first side of a body part through to a second side of the body part, for example, from the rear 120 to the front 121 of an earlobe 12 to form a pierced hole 122.

The piercing element 11 has a pointed front end 110 and a post back portion 111 that extends from the front end 110. The post 111 has at least a portion 114 thereof that is threaded.

A back element 13 comprises a generally flat disc 131 that is dimensioned to prevent a passage into the pierced hole 122. The back element 13 also comprises a generally cylindrical tube 132 affixed to the front face 133 of the disc 131. The tube 132 is dimensioned for passage into the pierced hole 122 and has a bore 134 extending from the front end 135 that is dimensioned to receive at least a portion of the post's back portion 111, including the threaded portion 114. The tube's bore 134 further has a threaded portion 136 for reversibly mating with the post's threaded rear portion 114. Preferably the tube 132 comprises a material that will prevent the wearer from experiencing an adverse reaction following piercing. Exemplary materials include, but are not intended to be limited to, a hypoallergenic metal and a plastic.

As with previous embodiments, an ornamental object 104 is matable with the back element 13 by means of a screwing motion of the threaded area 105 into threaded portion 136.

A second embodiment of this system 14 (FIG. 10) comprises a piercing element 15 adapted for being driven from a first side of a body part through to a second side of the body part, for example, from the rear 160 to the front 161 of an earlobe 16 to form a pierced hole 162. The piercing element 15 has a pointed front end 150 and a post back portion 151 that extends from the front end 150. The post 151 also has a notch 154.

A back element 17 comprises a generally flat disc 171 that is dimensioned to prevent a passage into the pierced hole 162. The back element 17 also comprises a generally cylindrical tube 172 affixed to the front face 173 of the disc 171. The tube 172 is dimensioned for passage into the pierced hole 162 and has a bore 174 extending from the front end 175 that is dimensioned to receive at least some of the post's back portion 151. The tube's bore 174 further has a notch 176 for reversibly mating with the post's notched 154 back portion 151. As above, preferably the tube 172 comprises a material that will prevent the wearer from experiencing an adverse reaction following piercing. Exemplary materials again include, but are not intended to be limited to, a hypoallergenic metal and a plastic.

As with previous embodiments, an ornamental object 144 is matable with the back element 17 by means of a snapping motion of the snap portion 146 into the bore 174 and notch 176.

It may be appreciated by one skilled in the art that additional embodiments may be contemplated, including attachment systems for other types of decorative jewelry.

In the foregoing description, certain terms have been used for brevity, clarity, and understanding, but no unnecessary limitations are to be implied therefrom beyond the requirements of the prior art, because such words a re used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. A body piercing system comprising:

a piercing element adapted for being driven from a first side of a body part through to a second side of the body part, the piercing element having a pointed front end and a generally cylindrical post extending from the front end and having attachment means disposed adjacent a back end thereof;

a back element comprising:

a generally flat disc dimensioned to prevent a passage into a pierced hole of a body part of a wearer and adapted to reside substantially flush against the body part and also having a substantially smooth rear surface that comprises no protrusions that would serve to cause discomfort when contacted by an opposing body part coming into contact with the rear surface; and an elongated member affixed to a front face of the disc dimensioned for passage into the pierced hole and having a bore extending from a front end dimensioned to receive at least a rear section of the post, the elongated member further having means for reversibly mating with the post attachment means and with an ornament attachment means.

2. The body piercing system recited in claim 1, wherein the elongated member comprises a generally cylindrical tube.

3. The body piercing system recited in claim 1, wherein the mating means comprises a threaded front section adapted to screwingly receive a female threaded ornament element.

4. The body piercing system recited in claim 1, wherein the piercing element attachment means comprises a threaded portion and the mating means comprises a female threaded portion adapted to screw onto the piercing element threaded portion.

5. The body piercing system recited in claim 1, wherein the mating means comprises a notch adapted for coupling with an ornament element having a notched tubular section.

6. The body piercing system recited in claim 1, wherein the mating means comprises a notch and the piercing element attaching means comprises a notch adapted to snappingly engage the post notch.

7. The body piercing system recited in claim 1, wherein the back element elongated member comprises a material selected from the group consisting of a hypoallergenic metal and a plastic.

8. A method for piercing a body part comprising the steps of:

driving a piercing assembly from a first side through to a second side of the body part, the piercing assembly comprising:

a piercing element having a pointed front end and a post extending from the front end; and a back element comprising a generally flat disc dimensioned to prevent a passage into a pierced hole of a body part of a wearer and adapted to reside substantially flush against the body part and also having a substantially smooth rear surface that comprises no protrusions that would serve to cause discomfort when contacted by an opposing body part coming into contact with the rear surface and an elongated member affixed to a front face of the disc dimensioned for passage into the pierced hole and having a bore extending from a front end into which is removably affixed at least a rear section of the post;

removing the piercing element from the body part second side, leaving the back element elongated member therein, a front end of the elongated member protruding from the body part second side and the flat disc resting against the body part first side; and affixing an ornamental element into the elongated member bore.

* * * * *